US012240724B2

(12) United States Patent
Miyazawa

(10) Patent No.: US 12,240,724 B2
(45) Date of Patent: Mar. 4, 2025

(54) MEDIUM DISCHARGE DEVICE, POST-PROCESSING DEVICE, RECORDING SYSTEM, CONTROL METHOD OF MEDIUM DISCHARGE DEVICE

(71) Applicant: SEIKO EPSON CORPORATION, Tokyo (JP)

(72) Inventor: Masaki Miyazawa, Matsumoto (JP)

(73) Assignee: SEIKO EPSON CORPORATION, Tokyo (JP)

( * ) Notice: Subject to any disclaimer, the term of this patent is extended or adjusted under 35 U.S.C. 154(b) by 190 days.

(21) Appl. No.: 18/177,323

(22) Filed: Mar. 2, 2023

(65) Prior Publication Data

US 2023/0278823 A1 Sep. 7, 2023

(30) Foreign Application Priority Data

Mar. 4, 2022 (JP) ..... 2022-033508

(51) Int. Cl.
*B65H 31/30* (2006.01)
*B65H 31/34* (2006.01)

(52) U.S. Cl.
CPC ..... *B65H 31/3018* (2013.01); *B65H 31/34* (2013.01); *B65H 2511/11* (2013.01); *B65H 2511/15* (2013.01); *B65H 2511/17* (2013.01); *B65H 2511/20* (2013.01); *B65H 2511/414* (2013.01); *B65H 2801/27* (2013.01)

(58) Field of Classification Search
CPC ..... B65H 29/20; B65H 29/22; B65H 31/34; B65H 31/36; B65H 31/38; B65H 31/3018; B65H 2405/332; B65H 2405/35; B65H 2405/351; B65H 2511/11; B65H 2511/15; B65H 2511/17; B65H 2511/20; B65H 2511/414; B65H 2515/40; B65H 2515/805; B65H 2801/24; B65H 2801/27
See application file for complete search history.

(56) References Cited

U.S. PATENT DOCUMENTS

2003/0006543 A1* 1/2003 Tamura ..... B65H 33/08 270/52.01
2005/0189690 A1* 9/2005 Kuwata ..... B42C 1/12 270/58.08

(Continued)

FOREIGN PATENT DOCUMENTS

JP 2013052937 A 3/2013

*Primary Examiner* — Prasad V Gokhale
(74) *Attorney, Agent, or Firm* — CHIP LAW GROUP

(57) ABSTRACT

A control unit controlling an operation of opening and closing a pair of support portions and an operation of displacing a loading tray in a loading direction can acquire curl information including information regarding the degree of curl of a medium. The control unit sets, based on the curl information, a position of the loading tray in the loading direction when the pair of support portions are opened and closed to a first position in a case where a condition when the pair of support portions are opened and closed is a first condition, and the position of the loading tray in the loading direction when the pair of support portions are opened and closed to a second position lower than the first position in a case where the condition is a second condition on which the medium curls more easily than on the first condition.

12 Claims, 7 Drawing Sheets

(56) References Cited

U.S. PATENT DOCUMENTS

| | | | | |
|---|---|---|---|---|
| 2011/0215520 | A1* | 9/2011 | Tsuchiya | G03G 15/6576 271/209 |
| 2013/0032992 | A1* | 2/2013 | Sato | B65H 33/08 271/220 |

* cited by examiner

MEDIUM DISCHARGE DEVICE, POST-PROCESSING DEVICE, RECORDING SYSTEM, CONTROL METHOD OF MEDIUM DISCHARGE DEVICE

The present application is based on, and claims priority from JP Application Serial Number 2022-033508, filed Mar. 4, 2022, the disclosure of which is hereby incorporated by reference herein in its entirety.

BACKGROUND

1. Technical Field

The present disclosure relates to a medium discharge device discharging a medium and a post-processing device including the medium discharge device. The present disclosure also relates to a recording system including the post-processing device. The present disclosure also relates to a control method of the medium discharge device discharging a medium.

2. Related Art

A post-processing device has been known that performs post-processing such as stapling or punching on a medium such as a sheet. An example of the post-processing device is described in JP-A-2013-52937.

The post-processing device according to JP-A-2013-52937 includes jogger and stack means including a pair of left and right joggers supporting a sheet discharged from sheet transport means. When the pair of left and right joggers is opened, a batch of sheets supported by the jogger and stack means is dropped onto a loading tray. This configuration can suppress misalignment of the batch of sheets as compared to a configuration in which a batch of sheets is directly discharged along the upper surface of a batch of sheets that has been already loaded on the loading tray.

When the batch of sheets loaded on the loading tray is curled, the batch of curled sheets may collide when the jogger and stack means is closed. To avoid such a problem, when the batch of sheets is dropped from the jogger and stack means to the loading tray, the loading tray is preferably located as below the jogger and stack means as possible.

However, when the batch of sheets is dropped from the jogger and stack means to the loading tray, the loading state is more easily disordered as the loading tray is located more downward.

SUMMARY

A medium discharge device according to an aspect of the present disclosure for solving the above problem is a medium discharge device including a discharge unit configured to discharge, in a discharge direction, a medium on which recording is performed, a pair of support portions configured to support the medium discharged by the discharge unit, the pair of support portions being configured to open and close by moving in mutually opposite directions in a width direction intersecting the discharge direction, and a loading tray at which the medium dropped by opening the pair of support portions is loaded, the loading tray being configured to be displaced in a loading direction, wherein a control unit configured to control an operation of opening and closing the pair of support portions and an operation of displacing the loading tray in the loading direction is configured to acquire curl information including information regarding a degree of curl of the medium, and the control unit sets, based on the curl information, a position of the loading tray in the loading direction when the pair of support portions are opened and closed to a first position in a case where a condition when the pair of support portions are opened and closed is a first condition, and the position of the loading tray in the loading direction when the pair of support portions are opened and closed to a second position lower than the first position in a case where the condition when the pair of support portions are opened and closed is a second condition on which the medium curls more easily than on the first condition.

Furthermore, a post-processing device according to another aspect of the present disclosure is a post-processing device that performs post-processing on a medium on which recording is performed by a recording device, the post-processing device including a processing tray configured to support the medium on which the post-processing is performed, a post-processing unit configured to perform the post-processing on the medium supported by the processing tray, and the above medium discharge device configured to discharge, from the processing tray, the medium on which the post-processing is performed.

In addition, a recording system according to still another aspect of the present disclosure includes a recording device including a recording unit configured to perform recording on a medium, and the above post-processing device configured to perform the post-processing on the medium on which the recording is performed by the recording device.

A control method of a medium discharge device according to still another aspect of the present disclosure is a control method of a medium discharge device, the medium discharge device including a discharge unit configured to discharge, in a discharge direction, a medium on which recording is performed, a pair of support portions configured to support the medium discharged by the discharge unit, the pair of support portions being configured to open and close by moving in mutually opposite directions in a width direction intersecting the discharge direction, and a loading tray at which the medium dropped by opening the pair of support portions is loaded, the loading tray being configured to be displaced in a loading direction, the control method including, based on curl information including information regarding a degree of curl of the medium, setting a position of the loading tray in the loading direction when the pair of support portions are opened and closed to a first position in a case where a condition when the pair of support portions are opened and closed is a first condition, and setting the position of the loading tray in the loading direction when the pair of support portions are opened and closed to a second position lower than the first position in a case where the condition when the pair of support portions are opened and closed is a second condition on which the medium curls more easily than on the first condition.

DESCRIPTION OF EXEMPLARY EMBODIMENTS

Figure 1:
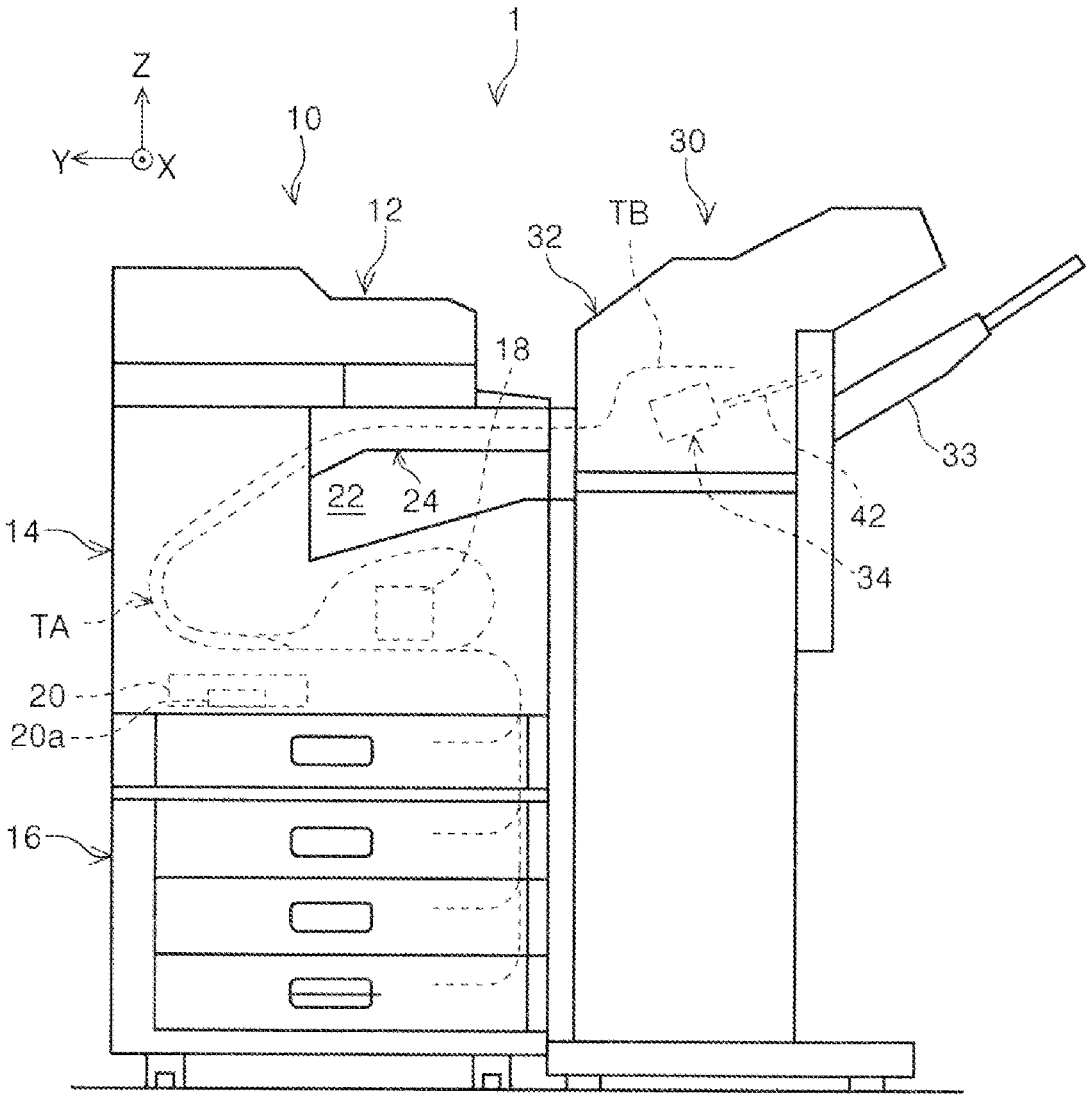
FIG. 1 is a front view of a recording system.

First, the present disclosure will be briefly described.

A medium discharge device according to a first aspect is a medium discharge device including a discharge unit configured to discharge, in a discharge direction, a medium on which recording is performed, a pair of support portions configured to support the medium discharged by the discharge unit, the pair of support portions being configured to open and close by moving in mutually opposite directions in a width direction intersecting the discharge direction, and a loading tray at which the medium dropped by opening the pair of support portions is loaded, the loading tray being configured to be displaced in a loading direction, wherein a control unit configured to control an operation of opening and closing the pair of support portions and an operation of displacing the loading tray in the loading direction is configured to acquire curl information including information regarding a degree of curl of the medium, and the control unit sets, based on the curl information, a position of the loading tray in the loading direction when the pair of support portions are opened and closed to a first position in a case where a condition when the pair of support portions are opened and closed is a first condition, and the position of the loading tray in the loading direction when the pair of support portions are opened and closed to a second position lower than the first position in a case where the condition when the pair of support portions are opened and closed is a second condition on which the medium curls more easily than on the first condition.

According to this aspect, the loading tray is closer to the pair of support portions in the case of the first condition than in the case of the second condition, and thus the loading state of the media on the loading tray is hard to be disordered on the first condition.

In addition, the loading tray is farther from the pair of support portions in the case of the second condition than in the case of the first condition, which can suppress a problem in which the medium in a curled state loaded at the loading tray is sandwiched between the pair of support portions when the pair of support portions are closed.

Consequently, it is possible to balance suppression of the disorder of the loading state on the loading tray and suppression of the sandwiching of the medium on the loading tray between the pair of support portions. Thus, more suitable post-processing can be performed.

According to a second aspect, in the first aspect, the curl information includes information of the medium.

According to this aspect, the curl information includes the information of the medium, and thus it is possible to suitably grasp ease of curl of the medium.

According to a third aspect, in the first or second aspect, the curl information includes recording information when the recording is performed on the medium.

According to this aspect, the curl information includes the recording information when the recording is performed on the medium, and thus it is possible to suitably grasp ease of curl of the medium.

According to a fourth aspect, in any of the first to third aspects, the curl information includes environment information.

According to this aspect, the curl information includes the environment information, and thus it is possible to suitably grasp ease of curl of the medium.

According to a fifth aspect, in any of the first to fourth aspects, the control unit closes the pair of support portions after opening the pair of support portions and before lowering the loading tray.

According to this aspect, the control unit closes the pair of support portions after opening the pair of support portions and before lowering the loading tray. Thus, it is possible to suppress the time during which the pair of support portions are open, rapidly restart support of the medium by the pair of support portions, and improve the throughput of the entire processing.

According to a sixth aspect, in any of the first to fifth aspects, the control unit is configured to select a first mode for determining the position of the loading tray in the loading direction based on the curl information or a second mode for determining the position of the loading tray in the loading direction without using the curl information.

According to this aspect, the control unit is configured to select the first mode for determining the position of the loading tray in the loading direction based on the curl information or the second mode for determining the position of the loading tray in the loading direction without using the curl information. Thus, it is possible to improve flexibility in selection by a user and improve usability of the device by the user.

A post-processing device according to a seventh aspect is a post-processing device that performs post-processing on a medium on which recording is performed by a recording device, the post-processing device including a processing tray configured to support the medium on which the post-processing is performed, a post-processing unit configured to perform the post-processing on the medium supported by the processing tray, and the medium discharge device according to any of the first to sixth aspects, the medium discharge device being configured to discharge, from the processing tray, the medium on which the post-processing is performed.

According to this aspect, a working effect of any of the above first to sixth aspects can be obtained in the post-processing device.

According to an eighth aspect, in the seventh aspect, end portions of the pair of support portions in a direction opposite to the discharge direction are located below an end portion of the processing tray in the discharge direction.

According to this aspect, the end portions of the pair of support portions in the direction opposite to the discharge direction are located below the end portion of the processing tray in the discharge direction. Thus, it is possible to suppress a trouble in which an end portion of the medium batch in the direction opposite to the discharge direction remains placed on the discharge unit and is not dropped when the medium batch is discharged from the processing tray.

According to a ninth aspect, in the eighth aspect, when a length of the medium in the discharge direction is such a length that the medium protrudes from the processing tray in the discharge direction in a state where the medium is supported by the processing tray, the second condition is satisfied.

When the length of the medium in the discharge direction is such a length that the medium protrudes from the processing tray in the discharge direction in a state where the medium is supported by the processing tray, a downstream region of the medium in the discharge direction hangs down and has a non-flat shape. Thus, the non-flat part is curled upward when the medium is discharged to the support portions, and this curl remains as it is even in a state where the medium is supported by the loading tray. According to this aspect, it is determined in such a case that the second condition is satisfied, and the loading tray is located at the second position lower than the first position. Thus, it is possible to suppress a problem in which the medium in a curled state loaded at the loading tray is sandwiched between the pair of support portions.

A recording system according to a tenth aspect includes a recording device including a recording unit configured to perform recording on a medium, and the post-processing device according to any of the seventh to ninth aspects, the post-processing device being configured to perform the post-processing on the medium on which the recording is performed by the recording device.

According to this aspect, a working effect of any of the above seventh to ninth aspects can be obtained in the recording system.

A control method of a medium discharge device according to an eleventh aspect is a control method of a medium discharge device, the medium discharge device including a discharge unit configured to discharge, in a discharge direction, a medium on which recording is performed, a pair of support portions configured to support the medium discharged by the discharge unit, the pair of support portions being configured to open and close by moving in mutually opposite directions in a width direction intersecting the discharge direction, and a loading tray at which the medium dropped by opening the pair of support portions is loaded, the loading tray being configured to be displaced in a loading direction, the control method including, based on curl information including information regarding a degree of curl of the medium, setting a position of the loading tray in the loading direction when the pair of support portions are opened and closed to a first position in a case where a condition when the pair of support portions are opened and closed is a first condition, and setting the position of the loading tray in the loading direction when the pair of support portions are opened and closed to a second position lower than the first position in a case where the condition when the pair of support portions are opened and closed is a second condition on which the medium curls more easily than on the first condition.

According to this aspect, the loading tray is closer to the pair of support portions in the case of the first condition than in the case of the second condition, and thus the loading state of the media on the loading tray is hard to be disordered on the first condition.

In addition, the loading tray is farther from the pair of support portions in the case of the second condition than in the case of the first condition, which can suppress a problem in which the medium in a curled state loaded at the loading tray is sandwiched between the pair of support portions when the pair of support portions are closed.

The present disclosure will be described in detail below.

A medium discharge device 40, a post-processing device 30, and a recording system 1 according to an embodiment of the present disclosure will be described below.

In each of the drawings, an X-axis direction is a device depth direction of the recording system 1. A +X direction, which is a direction of an arrow of the X-axis direction, is a direction from the back of the device toward the front of the device, and a −X direction is a direction from the front of the device toward the back of the device. The X-axis direction is an example of a width direction of a medium. A Y-axis direction is a device width direction of the recording system 1. A +Y direction, which is a direction of an arrow of the Y-axis direction, is a left direction when viewed from a user facing the front face of the device, and a −Y direction is a right direction.

A Z-axis direction is a device height direction of the recording system 1 and is a vertical direction. A +Z direction, which is a direction of an arrow of the Z-axis direction, is a vertically upward direction, and a −Z direction is a vertically downward direction. In the following description, the +Z direction may be simply referred to as upward, and the −Z direction may be simply referred to as downward.

As illustrated in FIG. 1, the recording system 1 includes a recording device 10 and the post-processing device 30. The recording device 10 according to the embodiment is an ink jet printer that performs recording by ejecting ink, which is an example of a liquid, to a medium typified by recording paper, and includes a line head 18, which is an example of a recording unit. Also, the recording device 10 is a so-called multifunction printer including a scanner unit 12 at an upper part of the device.

Figure 2:
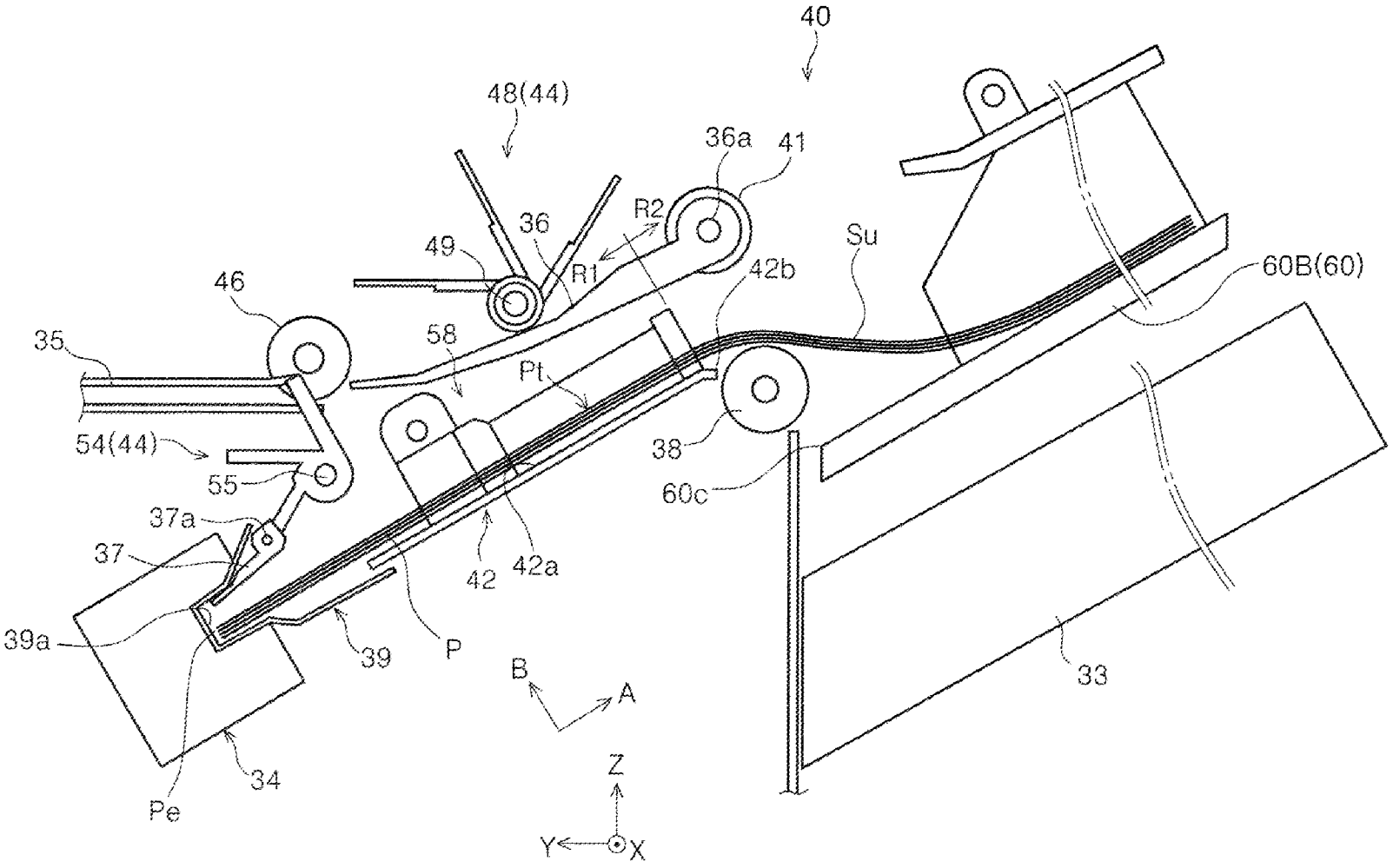
FIG. 2 is a view illustrating an internal configuration of a post-processing device.
Figure 4:
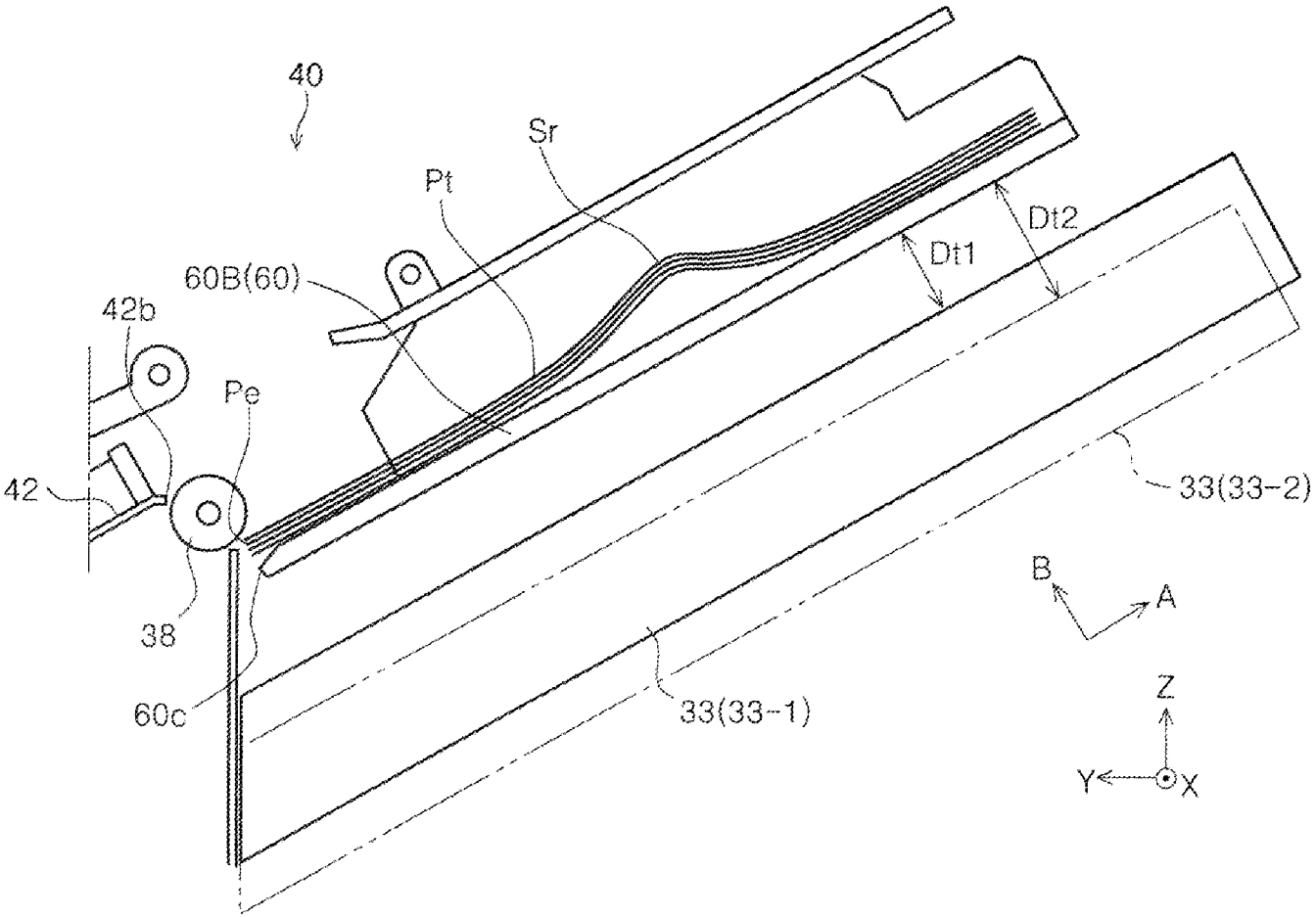
FIG. 4 is a view illustrating the internal configuration of the post-processing device.

The recording device 10 includes a main body 14, a medium accommodation unit 16 that accommodates the medium, a medium transport unit (not illustrated) that transports the medium, the line head 18 that performs recording on the medium, an in-case discharge unit 22 to which the medium is discharged, a relay unit 24 that transports the medium to the post-processing device 30, and a control unit 20 that controls the recording device 10, the post-processing device 30, and the medium discharge device 40 (see FIGS. 2 and 4). A transport path TA through which the medium is transported is provided inside the main body 14.

Note that in the embodiment, the control unit 20 is provided at the recording device 10, but may be provided at the post-processing device 30 or the medium discharge device 40 described below.

The line head 18 includes a plurality of ink ejecting nozzles (not illustrated) disposed corresponding to the entire region of the medium in the X-axis direction. The line head 18 ejects ink supplied from an ink tank (not illustrated) toward the medium from the plurality of ink ejecting nozzles, thereby performing recording on the medium. The control unit 20 includes a CPU (not illustrated) and a storage unit 20*a*. The storage unit 20*a* includes a storage medium such as a non-volatile memory. The storage unit 20*a* stores various programs, parameters, and the like for controlling the recording device 10 and the medium discharge device 40, the post-processing device 30, and the like described below. The programs include a program for controlling an operation of opening and closing an underlying support tray 60 and an operation of displacing a main tray 33 described below.

The medium on which recording has been performed by the recording device 10 is transported to the post-processing device 30 via the relay unit 24. The post-processing device 30 includes a device main body 32, a processing tray 42, a stapler 34, the medium discharge device 40 (see FIG. 2), and the main tray 33. The processing tray 42 and the stapler 34 are provided inside the device main body 32. The stapler 34 is an example of a post-processing unit. The medium discharge device 40 discharges the medium on which post-processing has been performed to the underlying support tray 60 (see FIG. 2). The main tray 33 is provided outside the device main body 32.

The medium received from the relay unit 24 by the device main body 32 is transported through a transport path TB inside the device main body 32 and fed to the processing tray 42.

A configuration of the post-processing device 30 will be further described below with reference to FIG. 2. Hereinafter, the medium is designated by the reference sign P and referred to as a medium P. A batch of media including the plurality of media P is designated by the reference sign Pt and referred to as a medium batch Pt.

Note that a direction along a support surface 42*a* of the processing tray 42 is referred to as an A-axis direction, and a +A direction of the A-axis direction is a discharge direction in which the medium batch Pt is discharged from the processing tray 42. In addition, a −A direction is a direction in which the medium P on the processing tray 42 is pulled back toward a rear end alignment unit 39. The A-axis direction is a direction including a +Z direction component and a −Y direction component in the embodiment. A direction orthogonal to the A-axis direction when viewed from the X-axis direction is referred to as a B-axis direction.

A guide member 35 constitutes part of the transport path TB and extends toward the processing tray 42. The medium P transported along the guide member 35 in the −Y direction is fed to the processing tray 42 by a transport roller 46 driven by a motor (not illustrated).

The medium P fed to the processing tray 42 is pulled back in the −A direction toward the rear end alignment unit 39 by a pulling-back unit 44. The pulling-back unit 44 includes a first paddle 48 and a second paddle 54.

The first paddle 48 is formed from an elastic material such as a rubber material and is provided rotatably about a rotational axis 49 extending in the X-axis direction. The first paddle 48 is driven in the clockwise direction in FIG. 2 by a motor (not illustrated), thereby applying a transmitting force in the −A direction to the medium P fed to the processing tray 42.

Similar to the first paddle 48, the second paddle 54 is also formed from an elastic material such as a rubber material and is provided rotatably about a rotational axis 55 extending in the X-axis direction. The second paddle 54 is driven in the clockwise direction in FIG. 2 by a motor (not illustrated), thereby applying a transmitting force in the −A direction to the medium P fed to the processing tray 42.

The rear end alignment unit 39 is provided in the −A direction relative to the processing tray 42. The rear end alignment unit 39 has an alignment surface 39*a* parallel to the B-axis direction. A rear end Pe of the medium batch Pt on the processing tray 42 comes into contact with the alignment surface 39*a*, and thus the rear end Pe of the medium batch Pt is aligned.

Side cursors 58 are provided so as to be movable in the X-axis direction by a drive source (not illustrated), and the side cursors 58 come into contact with end portions, in the X-axis direction, of the medium batch Pt supported by the processing tray 42, thereby aligning the end portions. Note that the side cursors 58 are disposed at intervals along the X-axis direction, and the two side cursor 58 are provided so as to move close to or away from each other. FIG. 2 illustrates one of the two side cursors 58 that is provided in the −X direction.

A flap 37 is disposed side by side with the rear end alignment unit 39 along the X-axis direction and provided so as to be swingable about a shaft portion 37*a* extending in the X-axis direction. The flap 37 presses the medium batch Pt on the processing tray 42 downward in the vicinity of the rear end alignment unit 39.

A pressing member 36 is provided so as to be swingable about a shaft portion 36*a* extending in the X-axis direction. The pressing member 36 is provided so as to be rotatable by a motor (not illustrated), and the medium P fed to the processing tray 42 by the transport roller 46 is knocked and dropped toward the processing tray 42 by rotation of the pressing member 36. Thus, an end portion, in the −A direction, of the medium P fed to the processing tray 42 is appropriately guided to the rear end alignment unit 39.

Figure 3:
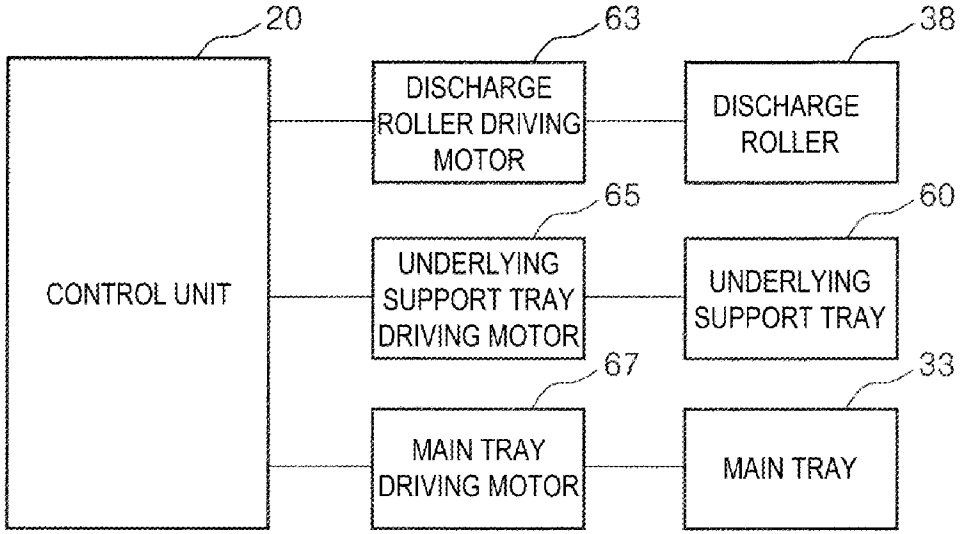
FIG. 3 is a block diagram illustrating a control system controlling a partial configuration of the post-processing device.

A discharge roller 38 is provided in the +A direction relative to the processing tray 42, the discharge roller 38 being an example of a discharge unit that discharges the medium batch Pt supported by the processing tray 42 in the +A direction. The discharge roller 38 is driven by a discharge roller driving motor 63 as illustrated in FIG. 3. The discharge roller driving motor 63 is controlled by the control unit 20.

In addition, a driven discharge roller 41 is provided above the discharge roller 38 so as to be able to move close to or away from the discharging roller 38. The driven discharge roller 41 is spaced apart from the discharge roller 38 except when the medium batch Pt is discharged from the processing tray 42. When the medium batch Pt is discharged from the processing tray 42, the discharge driven roller 41 moves toward the discharge roller 38 by a power source (not illustrated) and the medium batch Pt is nipped between the discharge driven roller 41 and the discharge roller 38.

In FIG. 2, the discharge roller 38 discharges, toward the underlying support tray 60, the medium batch Pt supported by the processing tray 42 and stitched by the stapler 34. Note that, in the embodiment, the post-processing is stitching processing by the stapler 34, but the post-processing is not limited thereto. The post-processing may be punching processing of punching a punch hole in the medium batch Pt, saddle stitch processing of saddle-stitching the medium batch Pt, shift discharging processing of discharging the medium batch Pt while the discharge positions are alternately shifted in the medium width direction, or the like. The medium batch Pt may be discharged without the post-processing and may be stacked on the main tray 33 in a so-called column stacking pattern.

Figure 6A:
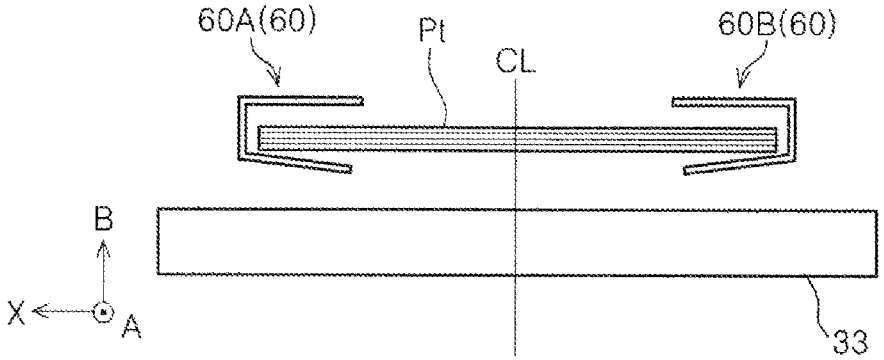
FIGS. 6A, 6B, and 6C are views illustrating the medium discharge device viewed from the discharge direction.
Figure 6B:
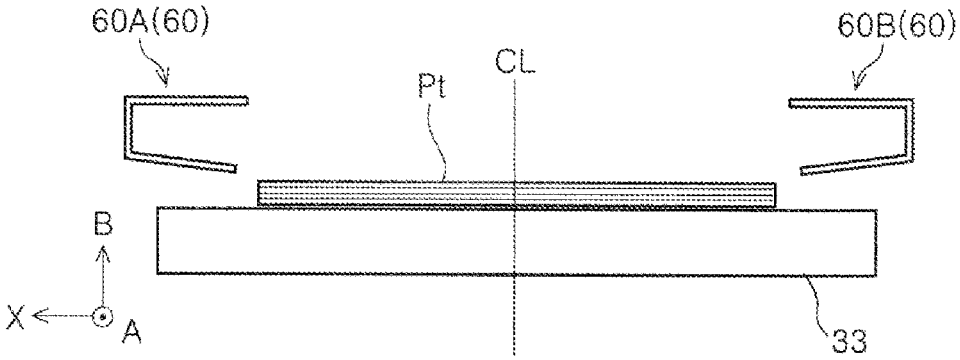
Figure 6C:
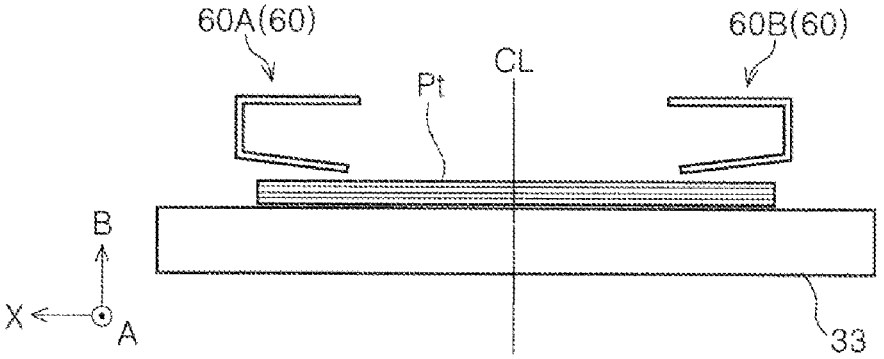

The underlying support tray 60 includes a first moving tray 60A and a second moving tray 60B provided spaced apart in the X-axis direction or the medium width direction as illustrated in FIGS. 6A, 6B, and 6C. The underlying support tray 60, that is, the first moving tray 60A and the second moving tray 60B are examples of the pair of support portions. The first moving tray 60A is located in the +X direction relative to the medium batch Pt, and the second moving tray 60B is located in the −X direction relative to the medium batch Pt. Each of the first moving tray 60A and the second moving tray 60B has such a shape that sandwiches, from the B-axis direction, the end portion of the medium batch Pt in the X-axis direction.

The first moving tray 60A and the second moving tray 60B are driven in the X-axis direction by an underlying support tray driving motor 65 as illustrated in FIG. 3. The underlying support tray driving motor 65 is controlled by the control unit 20.

In FIGS. 6A, 6B, and 6C, the underlying support tray 60 is opened and closed by moving the first moving tray 60A and the second moving tray 60B in the mutually opposite directions. Specifically, the underlying support tray 60 is opened by moving the first moving tray 60A and the second moving tray 60B away from each other and closed by moving the first moving tray 60A and the second moving tray 60B close to each other. In FIGS. 6A, 6B, and 6C, a straight line CL is a straight line that is parallel to the B-axis direction and that passes through the center position of the medium in the width direction. In the X-axis direction, the distance between the first moving tray 60A and the straight line CL and the distance between the second moving tray 60B and the straight line CL are always the same.

Note that the closing of the underlying support tray 60 means that the clearance between the first moving tray 60A and the second moving tray 60B in the X-axis direction is a clearance with which the medium batch Pt can be supported as illustrated in FIG. 6A. In addition, the opening of the underlying support tray 60 means that the clearance between the first moving tray 60A and the second moving tray 60B in the X-axis direction is a clearance with which the medium batch Pt is not supported and dropped to the main tray 33 as illustrated in FIG. 6B.

The medium batch Pt discharged by the discharge roller 38 is temporarily supported by the underlying support tray 60 in a closed state as illustrated in FIG. 6A. Then, the medium batch Pt supported by the underlying support tray 60 is dropped to the main tray 33 by opening the underlying support tray 60 as illustrated in FIG. 6B. After the medium batch Pt is dropped to the main tray 33, the underlying support tray 60 is closed as illustrated in FIG. 6C. After the underlying support tray 60 is closed, the main tray 33 moves downward to support the next medium batch Pt.

With such an underlying support tray 60, the loading state of the medium batch Pt on the main tray 33 can be improved.

The main tray 33 is an example of a loading tray at which the medium batch Pt that has been dropped by opening the underlying support tray 60 is loaded. The main tray 33 is driven in the loading direction or the Z-axis direction by a main tray driving motor 67 (see FIG. 3). The main tray driving motor 67 is controlled by the control unit 20.

Next, a problem when the underlying support tray 60 is closed will be described. First, as illustrated in FIG. 2, an end portion 60*c* of the underlying support tray 60 in the −A direction is located below an end portion 42*b* of the processing tray 42 in the +A direction. That is, a step is provided between the processing tray 42 and the underlying support tray 60. This can suppress a trouble in which the rear end Pe of the medium batch Pt remains placed on the discharge roller 38 and is not dropped when the medium batch Pt is discharged from the processing tray 42 to the underlying support tray 60.

Here, when the length of the medium P in the discharge direction is such a length that the medium P protrudes from the processing tray 42 in the +A direction in a state where the medium P is supported by the processing tray 42, the step between the processing tray 42 and the underlying support tray 60 causes the medium batch Pt to have a non-flat part Su. Note that the reference sign R1 in FIG. 2 designates a first region where the medium P is supported by the processing tray 42, and the reference sign R2 designates a second region where the medium P is not supported by the processing tray 42. When the length of the medium P in the discharge direction is longer than the length of the first region R1, the medium P has the non-flat part Su as described above. This non-flat part Su is curled upward as illustrated in FIG. 4 when discharged to the underlying support tray 60. The reference sign Sr designates an upwardly curled part.

Figure 5A:
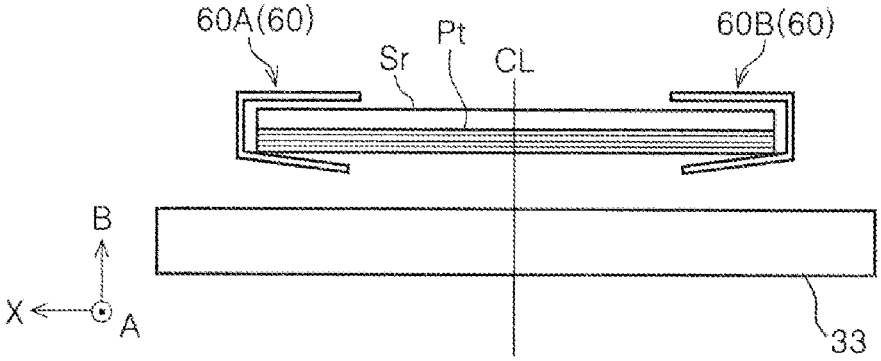
FIGS. 5A, 5B, and 5C are views illustrating a medium discharge device viewed from a discharge direction and views for describing a problem when an underlying support tray is closed.
Figure 5B:
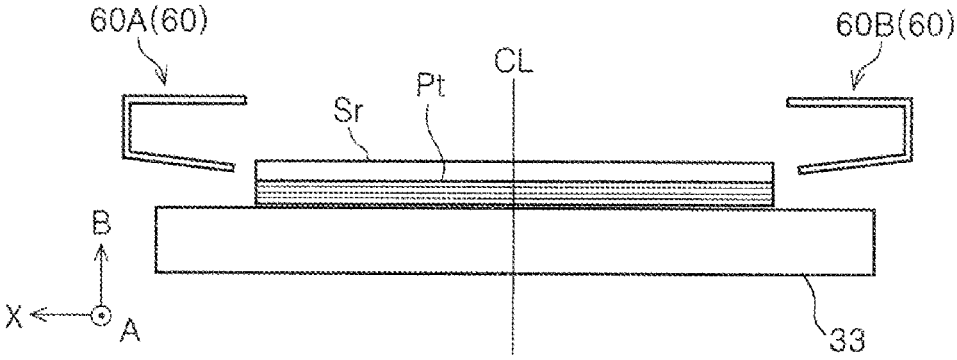
Figure 5C:
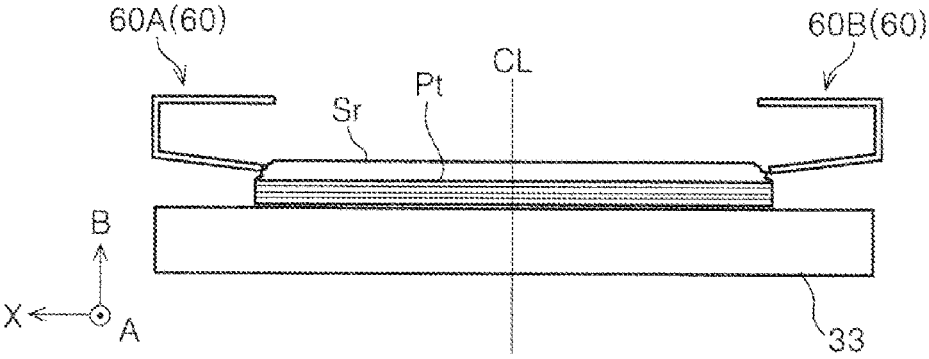

FIG. 5A illustrates a state in which the medium batch Pt having the curl part Sr is supported by the underlying support tray 60, and when the underlying support tray 60 is opened in this state, the medium batch Pt is dropped to the main tray 33 as illustrated in FIG. 5B. However, when the underlying support tray 60 is closed in this state, the curl part Sr is sandwiched in the underlying support tray 60 as illustrated in FIG. 5C and damages the medium batch Pt. This is a problem when the underlying support tray 60 is closed.

Note that this is not a problem only in the case of a configuration in which the step is provided between the processing tray 42 and the underlying support tray 60. That is, the curl part Sr may be formed due to factors other than the step, for example, recording performed on the medium P using a liquid such as ink. In such a case, the curl part Sr may be sandwiched in the underlying support tray 60.

The main tray 33 is preferably disposed as below as possible in order to avoid such a problem, but in this case, the loading state is easily disordered when the medium batch Pt is dropped from the underlying support tray 60 to the main tray 33.

Figure 7:
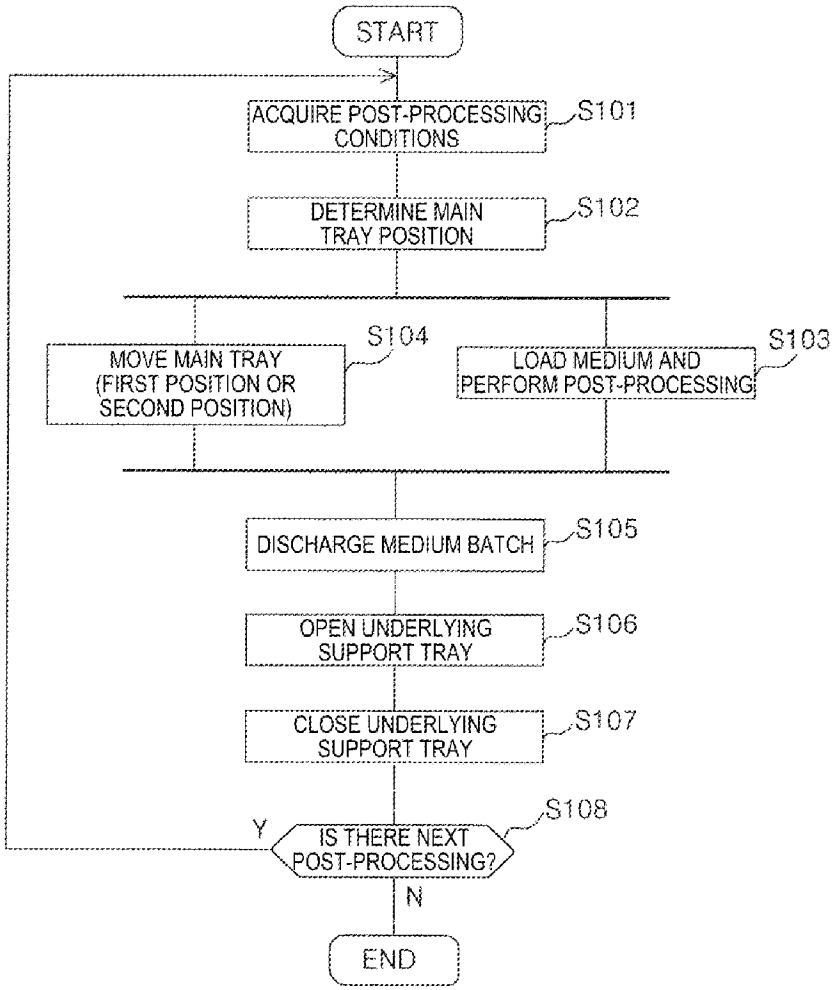
FIG. 7 is a flowchart illustrating control processing performed by a control unit.

In order to suppress the problem as described above, the control unit 20 performs control illustrated in FIG. 7.

The control unit 20 acquires post-processing conditions when performing post-processing (step S101). Here, the post-processing conditions include the following in the example.

Condition (1): Which of a first mode or a second mode is selected.

Condition (2): The type of the medium (plain paper, exclusive paper, or the like).

Condition (3): The size, orientation, and grain direction of the medium.

Condition (4): Recording information (recording concentration, recording area, and the like).

Condition (5): Environment information (temperature and humidity).

Condition (6): The details of the post-processing (stitching positions, the number of the stitching positions, and the like).

The conditions (1), (2), (3), and (6) can be acquired based on information set by the user via an operation panel (not illustrated) of the recording device 10 or a printer driver operating on a computer (not illustrated) that transmits recording data to the recording device 10.

The condition (4) can be acquired based on print data received by the recording device 10.

The condition (5) can be acquired from a temperature and humidity sensor (not illustrated). Note that this temperature and humidity sensor may be provided at either the recording device 10 or the post-processing device 30.

The conditions (1) to (6) described above are examples. Except the condition (6), all of the conditions (1) to (5) do not need to be necessarily acquired. For example, when the condition (1) is not acquired, the first mode described below may be selected. The first mode is a mode for switching the position of the main tray 33 in accordance with ease of curl of the medium P.

Additionally, the conditions (2), (3), (4), and (5) can be used for determination of ease of curl of the medium P, specifically, ease of forming the curl part Sr that has been described with reference to FIG. 4 and FIGS. 5A, 5B, and 5C. That is, the conditions (2), (3), (4), and (5) are examples of curl information including information regarding the degree of curl of the medium.

For example, regarding the condition (2), a medium having a low rigidity easily curls. For example, a plain paper curls more easily than exclusive paper. A flag "easy to curl" or "hard to curl" is set in accordance with the type of the medium, and this information is stored in the storage unit 20*a*. As an example, the flag "easy to curl" is set in the case of plain paper, and the flag "hard to curl" is set in the case of exclusive paper.

Further, regarding the condition (3), when the length (length in the A-axis direction) of the medium is such a length that the medium protrudes a predetermined length or more from the processing tray 42 in the +A direction, the medium easily curls. From this view point, the flag "ease to curl" or "hard to curl" is set in accordance with the medium length, and this information is stored in the storage unit 20*a*. As an example, when the length (length in the A-axis direction) of the medium is such a length that the medium protrudes a predetermined length or more from the processing tray 42 in the +A direction, the flag "easy to curl" is set, and otherwise, the flag "hard to curl" is set.

Regarding the condition (3), when the grain direction of the medium P is along the X-axis direction, the medium easily curls. Here, when the fibers of the paper are along a predetermined direction, this predetermined direction is the grain direction of the medium P. The flag "easy to curl" or "hard to curl" is set in accordance with the grain direction of the medium P, and this information is stored in the storage unit 20*a*. When the grain direction of the medium P is along the X-axis direction, the flag "easy to curl" is set, and when the grain direction of the medium P is not along the X-axis direction, the flag "hard to curl" is set.

Further, regarding the condition (4), the medium curls more easily as the recording concentration increases. As an example, the recording concentration can be determined based on the ratio between the number of dots formed by ink per unit area and the maximum number of dots that can be formed per unit area. The flag "easy to curl" or "hard to curl" is set in accordance with the recording concentration, and this information is stored in the storage unit 20*a*. As an example, when the recording concentration is equal to or greater than a predetermined concentration threshold value, the flag "easy to curl" is set, and when the recording concentration is less than the concentration threshold value, the flag "hard to curl" is set.

Additionally, regarding the condition (4), the medium curls more easily as the recording area in the second region R2 (see FIG. 2) increases. The flag "easy to curl" or "hard to curl" is set in accordance with the recording area, and this information is stored in the storage unit 20*a*. As an example, when the recording area is equal to or greater than a predetermined area threshold value, the "easy to curl" is set, and when the recording area is less than the area threshold value, the flag "hard to curl" is set.

In addition, regarding the condition (5), the medium curls more easily at a lower temperature and a lower humidity or at a higher temperature and a higher humidity. The flag "easy to curl" or "hard to curl" is set in accordance with the environment information, and this information is stored in the storage unit 20*a*. As an example, when the temperature and humidity are in a predetermined setting range (a high-temperature and high-humidity range or a low-temperature low-humidity range), the flag "easy to curl" is set, and when the temperature and humidity are not in the setting range, the flag "hard to curl" is set.

Next, the control unit 20 determines the position of the main tray 33 based on the acquired post-processing conditions (step S102). The position of the main tray 33 here means the position (position in the Z-axis direction) of the main tray 33 when the underlying support tray 60 supporting the medium batch Pt is opened and the medium batch Pt is dropped to the main tray 33. In detail below, the position of the main tray 33 includes a first position and a second position. The second position of the main tray 33 is lower than the first position of the main tray 33 and is suitable for the medium P that curls easily.

When at least one of the flags of the above-described conditions is "easy to curl", the control unit 20 according to the example determines that a second condition is satisfied and sets the position of the main tray 33 to the second position. Furthermore, when all of the flags of the above-described conditions are "hard to curl", the control unit 20 determines that a first condition is satisfied and sets the position of the main tray 33 to the first position.

However, this is an example, and for example, when the flags of a predetermined number of the conditions are "easy to curl", it may be determined that the second condition is satisfied, and otherwise, it may be determined that the first condition is satisfied. Alternatively, regarding the condition (3), the curl part Sr described with reference to FIG. 4 is formed when the length of the medium is such a length that the medium protrudes a predetermined length or more from the processing tray 42 in the +A direction. Thus, when the flag of the condition (3) is "hard to curl" in consideration of the medium length, it may be determined that the first condition is satisfied regardless of the other flags, and when the flag of the condition (3) is "easy to curl" in consideration of the medium length, whether the first condition or the second condition is satisfied may be determined based on the other flags.

When the first condition is satisfied, the main tray 33 is located at the first position described below, and when the second condition is satisfied, the main tray 33 is located at the second position described below.

Additionally, in the example, the first condition or the second condition is determined using all of the conditions (2) to (5) described above, but the first condition or the second condition may be determined using only one of the conditions (2) to (5) described above.

Here, the first position and the second position of the main tray 33 will be described in detail. In FIG. 4, the first position of the main tray 33 is a position where the clearance between the underlying support tray 60 and the main tray 33 or the uppermost medium batch Pt loaded at the main tray 33 is Dt1. Also, the second position of the main tray 33 is a position where the clearance between the underlying support tray 60 and the main tray 33 or the uppermost medium batch Pt loaded at the main tray 33 is Dt2. The clearance Dt2 is greater than the clearance Dt1 and is a clearance for avoiding collision between the underlying support tray 60 and the curl part Sr described with reference to FIG. 5C. In FIG. 4, the reference sign 33-1 designates the main tray 33 at the first position, and the reference sign 33-2 designates the main tray 33 at the second position.

Note that when the medium batch Pt is not loaded at the main tray 33, the clearances Dt1 and Dt2 are the clearance between the underlying support tray 60 and the main tray 33. When the medium batch Pt is loaded at the main tray 33, the clearances Dt1 and Dt2 are the clearance between the underlying support tray 60 and the uppermost medium batch Pt loaded at the main tray 33.

Note that the clearances Dt1 and Dt2 are not limited to a clearance having a fixed value. Specifically, the control unit 20 determines the clearances Dt1 and Dt2 in accordance with the thickness of the medium batch Pt to be discharged. That is, the clearance is set so that the medium batch Pt that has been dropped to the main tray 33 is not sandwiched in the underlying support tray 60 when the underlying support tray 60 is opened and then closed. The thickness of the medium batch Pt can be known based on the number of the media P and the thickness of each medium P. In particular, the clearance Dt2 is determined in consideration of the height (height in the B-axis direction) of the curl part Sr estimated based on the ease of curl of the medium P.

The control unit 20 also controls the height position of the main tray 33 based on the number of the medium batches Pt that have been already discharged to the main tray 33.

Returning to FIG. 7, the control unit 20 loads the media P at the processing tray 42, performs the post-processing on the medium batch Pt (step S103) when the loading is completed, and moves the main tray 33 to the first position or the second position (step S104). Step S103 and step S104 can be performed in parallel. When the second mode is selected, the main tray 33 is always located at the second position regardless of the curl information. However, in a case where suppression of disorder of the loading state on the main tray 33 is prioritized, when the second mode is selected, the main tray 33 may be always located at the first position regardless of the curl information.

Next, the control unit 20 discharges the medium batch Pt from the processing tray 42 to the underlying support tray 60 (step S105). Then, the control unit 20 opens the underlying support tray 60 to drop the medium batch Pt to the main tray 33 (step S106). Subsequently, the control unit 20 closes the underlying support tray 60 (step S107)

When there is next post-processing (Yes in step S108), the processing returns to step S101, and when there is no next post-processing (No in step S108), the processing ends. Note that, when the post-processing is continuously performed on the same conditions, step S101 may be omitted.

As described above, the medium discharge device 40 includes the underlying support tray 60 and the main tray 33. The control unit 20 that controls the operation of opening and closing the underlying support tray 60 and the operation of displacing the main tray 33 in the loading direction can acquire the curl information including information regarding the degree of curl of the medium P. In a case where the condition when the underlying support tray 60 is opened and closed is the first condition based on the curl information, the position of the main tray 33 in the loading direction when the underlying support tray 60 is opened and closed is the first position, and in a case where the condition when the underlying support tray 60 is opened and closed is the second condition on which the medium curls more easily than on the first condition, the position of the main tray 33 in the loading direction when the underlying support tray 60 is opened and closed is the second position lower than the first position. Because of this, the main tray 33 is closer to the underlying support tray 60 in the case of the first condition than in the case of the second condition. Thus, the loading state of the medium batch Pt on the main tray 33 is hard to be disordered on the first condition.

In addition, the main tray 33 is farther from the underlying support tray 60 in the case of the second condition than in the case of the first condition, which can suppress a problem in which the medium batch Pt in a curled state loaded at the main tray 33 is sandwiched in the underlying support tray 60 when the underlying support tray 60 is closed. As described above, it is possible to balance suppression of the disorder of the loading state on the main tray 33 and suppression of the sandwiching of the medium batch Pt on the main tray 33 by the underlying support tray 60. Thus, more suitable post-processing can be performed.

The curl information of the example includes information of the medium P (condition (2)).

The curl information of the example includes the recording information when recording has been performed on the medium P (condition (4)).

The curl information of the example also includes the environment information (condition (5)).

This makes it possible to suitably grasp the ease of curl of the medium P.

In addition, in the example, the control unit 20 closes the underlying support tray 60 (step S107) after opening the underlying support tray 60 (step S106) and before the operation of lowering the main tray 33 (step S104). This can suppress the time during which the underlying support tray 60 is open, rapidly restart support of the medium P by the underlying support tray 60, and improve the throughput of the entire processing.

In addition, in the example, the control unit 20 can select the first mode for determining the position of the main tray 33 in the loading direction based on the curl information or the second mode for determining the position of the main tray 33 in the loading direction without using the curl information. This can improve flexibility in selection by the user and improve usability of the device by the user.

In addition, in the example, when the length of the medium P in the discharge direction is such a length that the medium P protrudes from the processing tray 42 in the discharge direction (+A direction) in a state where the medium P is supported by the processing tray 42, the second condition is satisfied. This can suppress a problem in which the medium batch Pt in a curled state loaded at the main tray 33 is sandwiched in the underlying support tray 60.

Additionally, the disclosure is not intended to be limited to the aforementioned exemplary embodiment, and many variations are possible within the scope of the disclosure as described in the appended claims. It goes without saying that such variations also fall within the scope of the disclosure.

What is claimed is:

1. A medium discharge device comprising:

a discharge unit configured to discharge, in a discharge direction, a medium on which recording is performed;

a pair of support portions configured to support the medium discharged by the discharge unit, the pair of support portions being configured to open and close by moving in mutually opposite directions in a width direction intersecting the discharge direction; and a loading tray at which the medium dropped by opening the pair of support portions is loaded, the loading tray being configured to be displaced in a loading direction, wherein a control unit configured to control an operation of opening and closing the pair of support portions and an operation of displacing the loading tray in the loading direction is configured to acquire curl information including information regarding a degree of curl of the medium, and the control unit sets, based on the curl information, a position of the loading tray in the loading direction when the pair of support portions are opened and closed to a first position in a case where a condition when the pair of support portions are opened and closed is a first condition, and the position of the loading tray in the loading direction when the pair of support portions are opened and closed to a second position lower than the first position in a case where the condition when the pair of support portions are opened and closed is a second condition on which the medium curls more easily than on the first condition.

2. The medium discharge device according to claim 1, wherein the curl information includes information of the medium.

3. The medium discharge device according to claim 1, wherein the curl information includes recording information when the recording is performed on the medium.

4. The medium discharge device according to claim 1, wherein the curl information includes environment information.

5. The medium discharge device according to claim 1, wherein the control unit closes the pair of support portions after opening the pair of support portions and before lowering the loading tray.

6. The medium discharge device according to claim 1, wherein the control unit is configured to select a first mode for determining the position of the loading tray in the loading direction based on the curl information or a second mode for determining the position of the loading tray in the loading direction without using the curl information.

7. A post-processing device that performs post-processing on a medium on which recording is performed by a recording device, the post-processing device comprising:

a processing tray configured to support the medium on which the post-processing is performed;

a post-processing unit configured to perform the post-processing on the medium supported by the processing tray; and the medium discharge device according to claim 1, the medium discharge device being configured to discharge, from the processing tray, the medium on which the post-processing is performed.

8. The post-processing device according to claim 7, wherein end portions of the pair of support portions in a direction opposite to the discharge direction are located below an end portion of the processing tray in the discharge direction.

9. The post-processing device according to claim 8, wherein when a length of the medium in the discharge direction is such a length that the medium protrudes from the processing tray in the discharge direction in a state where the medium is supported by the processing tray, the second condition is satisfied.

10. A recording system comprising:

a recording device including a recording unit configured to perform recording on a medium; and the post-processing device according to claim 7, the post-processing device being configured to perform the post-processing on the medium on which the recording is performed by the recording device.

11. The recording system according to claim 10, wherein the recording device performs the recording by ejecting a liquid to the medium.

12. A control method of a medium discharge device, the medium discharge device including a discharge unit configured to discharge, in a discharge direction, a medium on which recording is performed, a pair of support portions configured to support the medium discharged by the discharge unit, the pair of support portions being configured to open and close by moving in mutually opposite directions in a width direction intersecting the discharge direction, and a loading tray at which the medium dropped by opening the pair of support portions is loaded, the loading tray being configured to be displaced in a loading direction, the control method comprising:

based on curl information including information regarding a degree of curl of the medium, setting a position of the loading tray in the loading direction when the pair of support portions are opened and closed to a first position in a case where a condition when the pair of support portions are opened and closed is a first condition; and setting the position of the loading tray in the loading direction when the pair of support portions are opened and closed to a second position lower than the first position in a case where the condition when the pair of support portions are opened and closed is a second condition on which the medium curls more easily than on the first condition.

* * * * *